US011173369B1

(12) United States Patent
Reynard

(10) Patent No.: US 11,173,369 B1
(45) Date of Patent: Nov. 16, 2021

(54) STATIONARY SWIMMING DEVICE AND METHOD

(71) Applicant: Timothy Myles Reynard, Hernando, FL (US)

(72) Inventor: Timothy Myles Reynard, Hernando, FL (US)

( * ) Notice: Subject to any disclaimer, the term of this patent is extended or adjusted under 35 U.S.C. 154(b) by 61 days.

(21) Appl. No.: 15/919,396

(22) Filed: Mar. 13, 2018

Related U.S. Application Data

(60) Provisional application No. 62/528,364, filed on Jul. 3, 2017.

(51) Int. Cl.
*A63B 69/12* (2006.01)
*A63B 69/00* (2006.01)

(52) U.S. Cl.
CPC ..... *A63B 69/12* (2013.01); *A63B 69/0057* (2013.01)

(58) Field of Classification Search
CPC ..... A63B 69/12; A63B 69/0057; A63B 69/00; A63B 69/125; A63B 69/14
See application file for complete search history.

(56) References Cited

U.S. PATENT DOCUMENTS 2,434,543 A 1/1948 Borroughs
2,875,528 A 3/1959 Garate
3,140,550 A 7/1964 Wayfield
3,512,416 A * 5/1970 Hohwart ..... A63B 69/12 73/379.09
3,724,012 A * 4/1973 Sanderson ..... A63B 69/12 441/55
3,861,675 A 1/1975 Hopper
3,988,020 A 10/1976 Carter
4,095,657 A * 6/1978 Hohwart ..... A63B 69/12 434/254
4,109,905 A 8/1978 Meier
4,218,056 A 8/1980 Whitling
4,247,096 A 1/1981 Schmitt
4,519,783 A 5/1985 Burke, Jr.
4,524,711 A 6/1985 Ashrow
4,530,497 A 7/1985 Moran et al.
4,962,923 A 10/1990 Earner
5,083,522 A 1/1992 Ashrow
5,236,404 A 8/1993 MacLennan
5,344,373 A 9/1994 Greene
5,556,353 A 9/1996 Beers
5,601,514 A 2/1997 Horn
5,816,982 A 10/1998 Croushore
5,846,167 A 12/1998 Liu et al.
6,176,815 B1 1/2001 Riera
6,251,049 B1 6/2001 Milton
6,634,993 B1 10/2003 Morr
(Continued)

*Primary Examiner* — Nyca T Nguyen
*Assistant Examiner* — Andrew M Kobylarz
(74) *Attorney, Agent, or Firm* — John Rizvi; John Rizvi, P.A.—The Patent Professor®

(57) ABSTRACT

A swimming exercise device, comprising a restraint including an opening and a contact portion, the restraint configured to receive a head of a user through the opening and to restrain the user, via contact between shoulders of the user and the contact portion, such that the user is held substantially stationary during forward motion of the user against the restraint and an abutment structure configured to contact a pool surface and transmit forces associated with the forward motion of the user against the restraint to the pool surface.

8 Claims, 10 Drawing Sheets

(56) References Cited

U.S. PATENT DOCUMENTS

| | | | | |
|---|---|---|---|---|
| 6,905,444 | B2 | 6/2005 | Milton | |
| 6,966,870 | B2 | 11/2005 | Lan | |
| 7,104,932 | B1 | 9/2006 | Brentlinger | |
| 7,175,569 | B1 | 2/2007 | Lan et al. | |
| 7,185,598 | B1 | 3/2007 | Lan et al. | |
| 7,273,444 | B2 | 9/2007 | Chang | |
| 7,442,151 | B1 * | 10/2008 | Berdegue | A63B 69/12 434/254 |
| 7,563,206 | B1 | 7/2009 | Bellerive | |
| 8,007,410 | B2 | 8/2011 | Mayaud | |
| 8,641,580 | B2 | 2/2014 | Bellerive | |
| 2006/0166175 | A1 * | 7/2006 | Lan | A63B 69/12 434/254 |
| 2009/0298652 | A1 * | 12/2009 | Lessard | A63B 69/12 482/55 |

* cited by examiner

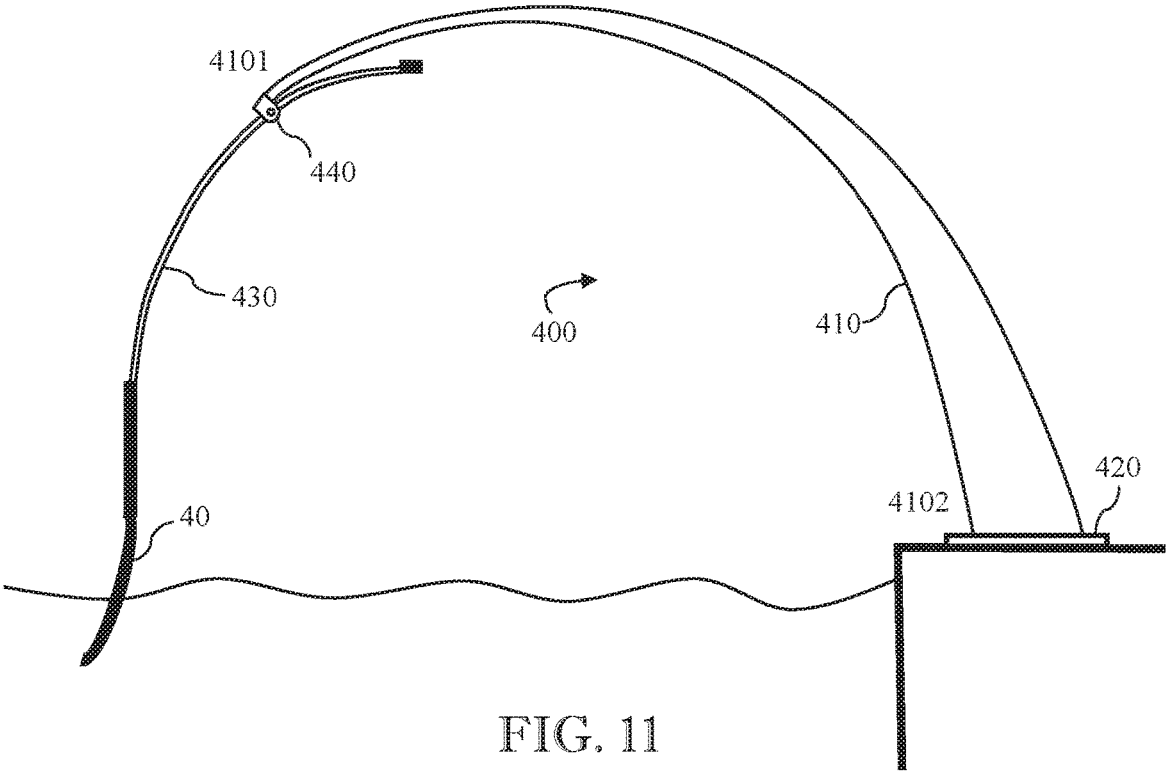
FIG. 11
FIG. 12A
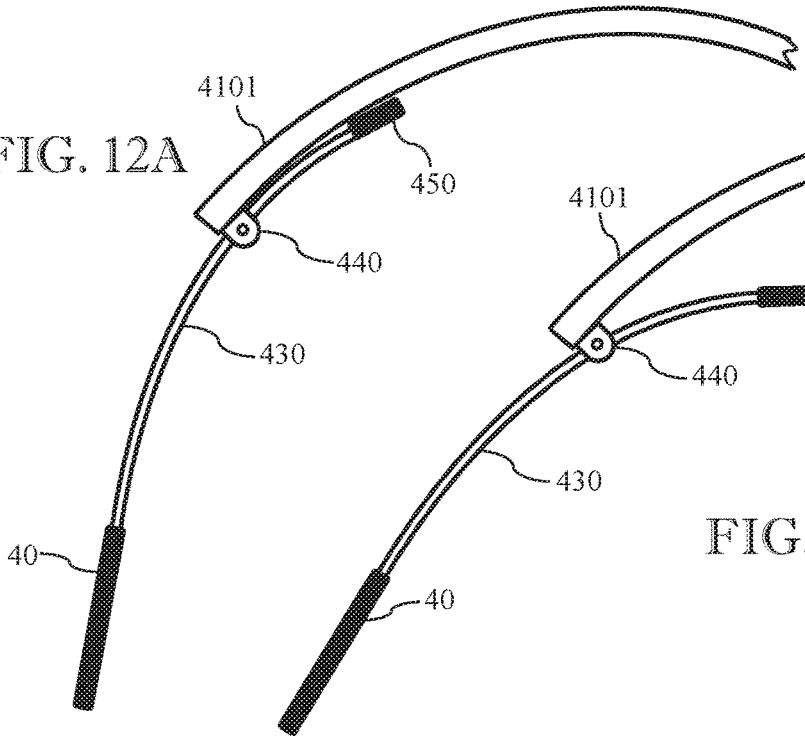
FIG. 12B

STATIONARY SWIMMING DEVICE AND METHOD

CROSS-REFERENCE TO RELATED APPLICATION

This application claims the benefit of U.S. Provisional Patent Application Ser. No. 62/528,364, filed Jul. 3, 2017, which is incorporated herein in its entirety.

FIELD OF THE INVENTION

The field of this invention relates to the activity of swimming, and more particularly to a swimming exercise, training, and physical therapy device in which the swimmer is free to swim while remaining fixed in place within a confined area of a swimming pool or other body of water, with minimal interference in the use of the pool with other swimmers.

BACKGROUND OF THE INVENTION

Swimming is a beneficial exercise, especially as a low-impact, cardiovascular aerobic fitness activity. Swimming has long been an enjoyable and popular form of recreation that has increasingly been touted as a desirable form of low-impact exercise for most of the major muscle groups, with cardiovascular aerobic benefits.

Swimming pools at most residential homes, apartments and hotels are generally too small or too crowded to allow long swimming laps without having to frequently turn around or interfering with other swimmers, which interrupts the swimming enjoyment and exercise routine. The need exists for a means of confining a swimmer to a limited area such that they are able to avoid other swimmers, divers, bumping into walls, ladders, slides, steps, and/or other objects. The need for a means of containing a swimmer to a limited area is further demonstrated during swim training, such that a coach would be able to stand adjacent to the swimmer and provide close instruction. Other instances when confining a swimmer to a limited area is desirable are during physical therapy, for people with injuries, disabilities or poor vision.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

The present invention relates to a swimming exercise, training, and physical therapy device allowing a swimmer to swim in place with a normal swimming motion within a confined body of water, passively restrained from the forward motion that would normally accompany the swimming strokes, thereby enjoying longer intervals of uninterrupted cardiovascular aerobic benefits, and lessening the interference with other swimmers.

The present invention provides a convenient means of restricting the swimmer's forward movement in a confined area while maintaining a natural swim stroke without having to attach anything to the body. It is an objective of the instant invention to provide a restraint to allow free swimming motion without binding the body in some fashion, pulling on some part of the body that either interferes with the normal movement of the swimmer, or is uncomfortable or awkward to engage or disengage with before or after exercising.

Part of accomplishing a natural swimming movement is keeping oneself afloat by stroking with the arms and kicking with the legs and feet to maintain a position near the surface of the water. It is an objective of the present invention to provide a natural swimming stoke without artificial floatation buoyancy or without tugging at a particular point on the body, which tends to create an unnatural feel.

Another objective of the present invention is to provide a means of accomplishing training or physical therapy in a limited space. This invention can be used in conjunction with a flotation device for training or physical therapy if a swimmer is inexperienced, injured, or impaired in such a manner that flotation and restraint are necessary for the exercise to be conducted safely and with the aid of a trainer or physical therapist.

Yet still a further purpose of the present invention is to provide a restraining device whereby a large number of swimmers may perform a swimming exercise in a relatively small pool.

An additional objective of the present invention is to provide a swimming exercise device whereby the user may quickly and easily be released from the device in case of an emergency such as a taking in water and choking, muscle cramp, heart palpation, asthma attack, etc.

The present invention accomplishes the objectives mentioned by providing a casual and passive resistance on both shoulders at the base of the neck during the swimming motion to provide a restraint to the forward motion of the swimmer. In this context casual engagement means relaxed, impermanent, and unrestrained engagement. The device is convenient to use, safe, compact, and that does not impede the natural swimming motion. The device can be of a configuration that is either permanently installed or portable.

Disclosed is a swimming exercise device, comprising a restraint including an opening and a contact portion, the restraint configured to receive a head of a user through the opening and to restrain the user, via contact between shoulders of the user and the contact portion, such that the user is held substantially stationary during forward motion of the user against the restraint, and an abutment structure configured to contact a pool surface and transmit forces associated with the forward motion of the user against the restraint to the pool surface.

In another aspect, the restraint includes a stanchion.

In another aspect, the device further comprises a resistance arm including one or more interlocking tubular members, a first end, and a second end, wherein the abutment structure includes a T-shaped member and cross braces that each carry a floatation member configured to facilitate floatation of the swimming exercise device, wherein the abutment structure is arranged at the first end, wherein the stanchion is U-shaped, and wherein the stanchion is arranged at the second end.

In another aspect, the abutment structure includes a frame configured to stand vertically on a bottom pool surface, the stanchion includes left and right resistance members that may (in some embodiments) curve to define the opening, and the left and right resistance members are variably angled relative to the frame via one or more hinges, such that a size of the opening is variable. It is to be understood that the stanchions may be straight or curved without departing from the spirit or scope of this disclosure.

In another aspect, the device further comprises a cantilever resistance arm including a Clevis bracket swivelingly coupled to a resistance arm extension, a first end, and a second end, wherein the stanchion is U-shaped and is coupled to the resistance arm extension toward the first end, and wherein the abutment structure includes a mounting base coupled to the pool surface and is coupled to the cantilever resistance arm toward the second end.

In another aspect, the device further comprises a cantilever resistance arm including a first end and a second end, wherein the stanchion is U-shaped and is coupled to the resistance arm at the first end, the stanchion including swiveling extension bars, wherein the abutment structure includes a mounting base coupled to the pool surface, and wherein the abutment structure is coupled to the cantilever resistance arm at the second end.

In another aspect, the restraint includes two resistance cords.

In another aspect, the abutment structure includes a frame configured to stand vertically on a bottom pool surface, the frame having a first vertical end and a second vertical end, the resistance cords are held vertically side by side between the first and second vertical ends, and the resistance cords are variably separable and vertically adjustable to variably define the opening.

In another aspect, the abutment structure includes a substantially semi-circular frame attached to a support arm that swivels on a mounting base coupled to the pool surface, the resistance cords are held vertically side by side between first and second vertical ends of the frame, and the resistance cords are variably separable and vertically adjustable to variably define the opening.

In another aspect, the device further comprises a cantilever resistance arm, wherein the resistance cords are held vertically side by side between the cantilever resistance arm and an in-pool weight at a bottom pool surface, and wherein the resistance cords are variably separable and vertically adjustable to variably define the opening.

In another configuration, the device comprises a restraint configured to hold a user substantially stationary during forward motion of the user against the restraint while swimming, and an abutment structure configured to contact a pool surface and transmit forces associated with the forward motion of the user against the restraint to the pool surface, wherein the restraint is releasably engageable with shoulders of the user.

In another aspect, the device further comprises a resistance arm including one or more interlocking tubular members, a first end, and a second end, wherein the restraint includes a stanchion, wherein the abutment structure includes a T-shaped member and two cross braces that each carry a floatation member configured to facilitate floatation of the swimming apparatus, wherein the abutment structure is arranged at the first end and is configured to abut the pool surface, wherein the stanchion is U-shaped, and wherein the stanchion is arranged at the second end.

In another aspect, the restraint includes a stanchion, the abutment structure includes a frame configured to stand vertically on a bottom pool surface, the stanchion includes left and right resistance members that may (in some embodiments) curve to define an opening of the stanchion, and the left and right resistance members are variably angled relative to the frame via one or more hinges, such that a size of the opening is variable. It is to be understood that the stanchions may be straight or curved without departing from the spirit or scope of this disclosure.

In another aspect, the device further comprises a cantilever resistance arm including a Clevis bracket swivelingly coupled to a resistance arm extension, a first end, and a second end, wherein the restraint includes a stanchion, wherein the stanchion is U-shaped and is coupled to the resistance arm extension toward the first end, and wherein the abutment structure includes a mounting base coupled to the pool surface and is coupled to the cantilever resistance arm toward the second end.

In another aspect, the device further comprises a cantilever resistance arm including a first end and a second end, wherein the restraint includes a stanchion, wherein the stanchion is U-shaped and is coupled to the resistance arm at the first end, the stanchion including two swiveling extension bars, and wherein the abutment structure includes a mounting base coupled to the pool surface and is coupled to the cantilever resistance arm at the second end.

In another aspect, the restraint includes two resistance cords, the abutment structure includes a frame configured to stand vertically on a bottom pool surface, the frame having a first vertical end and a second vertical end, the resistance cords are held vertically side by side between the first and second vertical ends, and the resistance cords are variably separable and vertically adjustable to variably define an opening between the resistance cords.

In another aspect, the restraint includes two resistance cords, the abutment structure includes a substantially semi-circular frame attached to a support arm that swivels on a mounting base coupled to the pool surface, the resistance cords are held vertically side by side between first and second vertical ends of the frame, and the resistance cords are variably separable and vertically adjustable to variably define an opening between the resistance cords.

In another aspect, the device further comprises a cantilever resistance arm, wherein the restraint includes two resistance cords, wherein the resistance cords are held vertically side by side between the cantilever resistance arm and an in-pool weight at a bottom pool surface, and wherein the resistance cords are variably separable and vertically adjustable to variably define an opening between the resistance cords.

In another aspect, disclosed is a swimming device having a restraint configured to restrain a user engaging in forward swimming motion by a neck and shoulders of the user, and an abutment structure configured to contact a pool surface, wherein a force associated with the forward swimming motion is transmitted from the restraint to the pool surface through the abutment structure, thereby generating an opposing force that prevents translation of the user.

In another aspect, the restraint includes one of a stanchion and a pair of resistance cords, and the abutment structure includes one of a frame configured to stand vertically on a first pool surface and a mounting base coupled to a second pool surface.

1. Portable In-Pool Floating Stanchion Device:

One embodiment of the instant invention is an in-pool device that restrains the forward motion of the swimmer against both shoulders at the base of the neck with a U-shaped stanchion configured to conform to the shape of the shoulders thereby providing casual engagement and resistance during the swimming action, substantially preventing forward motion, while at the same time accommodating the natural movements of the swimmer.

The U-shaped stanchion extends with the open end downward in a configuration adapted to receive a swimmer's head between the prongs and provide resistance against both shoulders at the base of the neck with sufficient pressure during the swimming action for maintaining there between a mated relationship providing resistance in a manner such that uninterrupted stroking and/or kicking is facilitated in a pool area of relatively small dimensions. The stanchion is attached to a resistance arm extending outward from the wall at the side of the pool over the water to remain clear of the swimmer's stoke. The device generally floats at the surface of the water when not in use. While in use, the resistance arm is braced against the pool wall to prevent forward movement.

It is an objective of the present invention to provide a swimming exercise device that is lightweight, compact, portable and may easily be dis-assembled for storage or transport, and re-assembled for quick and easy implementation at any swimming pool and at any location within the pool, thus giving the user the flexibility to easily avoid crowded, high traffic, deep, or shady sections of a swimming pool.

Another objective of the present invention is to provide a swimming exercise device that requires very little space when utilized in a swimming pool and provides minimal interference to other swimmers with the use of the pool.

Another objective of the present invention is to construct a device that can be manufactured inexpensively, is small in size, lightweight and can therefore be readily carried by the individual to a particular desired location.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

Yet another objective of the present invention is to provide a swimming exercise device that can easily be removed from the water.

2. In-Pool Frame with Bands Device:

Another embodiment of the instant invention is an in-pool device submerged in the water during use that restrains the swimmer against both shoulders at the base of the neck with padded cords structured vertically thereby providing casual engagement and resistance during the swimming action, substantially preventing forward motion, while at the same time accommodating the natural movements of the swimmer in a manner such that uninterrupted stroking and/or kicking is facilitated in a pool area of relatively small dimensions. The cords are attached to a frame that rests on the bottom of the pool and uses the side wall of the pool as a brace to prevent forward movement. The frame extends above and below the swimmer to remain clear of the swimmer's stoke. The cords are perpendicular to the bottom of the pool and held substantially taught by the frame.

It is an objective of the present invention to provide a swimming exercise device that is easily implemented in most any swimming pool and at most any location within the pool, thus giving the user the flexibility to easily avoid crowded, high traffic, deep, or shady sections of a swimming pool.

Another objective of the present invention is to provide a swimming exercise device that requires very little space when utilized in a swimming pool and provides minimal interference to other swimmers with the use of the pool.

Another objective of the present invention is to provide a swimming exercise device that is lightweight enough that it can therefore be readily carried by the individual to a particular desired location.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

Yet another objective of the present invention is to provide a swimming exercise device that can easily be removed from the water.

3. In-Pool Frame Stanchion:

An additional embodiment of the instant invention is an in-pool device submerged in the water during use that restrains the swimmer against both shoulders at the base of the neck with a pair of substantially ridged stanchions configured to conform to the shape of the shoulders that are hinged at the vertical base frame thereby providing casual engagement and resistance during the swimming action, substantially preventing forward motion, while at the same time accommodating the natural movements of the swimmer in a manner such that uninterrupted stroking and/or kicking is facilitated in a pool area of relatively small dimensions. The frame is generally a rectangular shape and rests on the bottom of the pool and uses the side wall of the pool as a brace to prevent forward movement. The frame has two feet that extend away from the wall to provide stability in the opposite direction.

It is an objective of the present invention to provide a swimming exercise device that is easily implemented in most any swimming pool and at most any location within the pool, thus giving the user the flexibility to easily avoid crowded, high traffic, deep, or shady sections of a swimming pool.

Another objective of the present invention is to provide a swimming exercise device that requires very little space when utilized in a swimming pool and provides minimal interference to other swimmers with the use of the pool.

Another objective of the present invention is to provide a swimming exercise device that is lightweight enough that it can therefore be readily carried by the individual to a particular desired location.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

Yet another objective of the present invention is to provide a swimming exercise device that can easily be removed from the water.

4. Permanent Pool-Side Base-Mounted Bow:

In the case of a pool made of concrete or other strong material, the device can be mounted on or firmly attached in some suitable manner to the pool deck itself. Another embodiment of the instant invention is a deck-mounted device adapted to receive a swimmer's head that restrains the forward motion of the swimmer against both shoulders at the base of the neck with padded cords structured vertically thereby providing casual engagement and resistance during the swimming action, substantially preventing forward motion, while at the same time accommodating the natural movements of the swimmer in a manner such that uninterrupted stroking and/or kicking is facilitated in a pool area of relatively small dimensions The cords are attached to a C-shaped, substantially semi-circular, frame that is attached to a support arm that swivels on a base mounted to the pool deck as a brace to prevent forward movement. The C-shaped semi-circular frame extends above and below the swimmer and the surface of the water to remain clear of the swimmer's stoke. The cords are perpendicular to the bottom of the pool and held substantially taught by the frame.

It is an objective of the present invention that another embodiment includes a swimming exercise device that can be permanently base mounted to the deck of a swimming pool so as to not be portable or easily transported.

Another objective of the present invention is to provide a swimming exercise device that requires very little space when utilized in a swimming pool and provides minimal interference to other swimmers with the use of the pool.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

Yet another objective of the present invention is to provide a swimming exercise device that can easily be swiveled out of the water when not in use in order to maintain the cords.

Another embodiment includes a base of a substantially tripodal configuration, including skid-resistant feet on the deck of a water-filled pool.

5. Permanent Pool-Side Base-Mounted Cantilever Stanchion:

In the case of a pool made of concrete or other strong material, the device can be mounted on or firmly attached in some suitable manner to the pool deck itself. Another embodiment of the instant invention is a deck-mounted device that restrains the forward motion of the swimmer against both shoulders at the base of the neck with a U-shaped stanchion configured to conform to the shape of the shoulders thereby providing casual engagement and resistance during the swimming action, substantially preventing forward motion, while at the same time accommodating the natural movements of the swimmer in a manner such that uninterrupted stroking and/or kicking is facilitated in a pool area of relatively small dimensions.

The U-shaped stanchion extends with the open end downward in a configuration adapted to receive a swimmer's head between the prongs and provide resistance against both shoulders at the base of the neck with sufficient pressure during the swimming action for maintaining there between a mated relationship providing resistance in a manner such that uninterrupted stroking and/or kicking is facilitated in a pool area of relatively small dimensions. The stanchion is attached to a cantilever resistance arm extending outward from the pool deck at the side of the pool over the water to remain clear of the swimmer's stoke. The cantilever resistance arm is attached to the pool deck as a brace to prevent forward movement.

It is an objective of the present invention that another embodiment includes a swimming exercise device that can be permanently base mounted to the deck of a swimming pool so as to not be portable or easily transported.

Another objective of the present invention is to provide a swimming exercise device that requires very little space when utilized in a swimming pool and provides minimal interference to other swimmers with the use of the pool.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

6. Permanent Pool-Side Base-Mounted Cantilever with In-Pool Bottom Weight:

In the case of a pool made of concrete or other strong material, the device can be mounted on or firmly attached in some suitable manner to the pool deck itself. Another embodiment of the instant invention is a deck-mounted device adapted to receive a swimmer's head that restrains the forward motion of the swimmer against both shoulders at the base of the neck with padded cords structured vertically thereby providing casual engagement and resistance during the swimming action, substantially preventing forward motion, while at the same time accommodating the natural movements of the swimmer in a manner such that uninterrupted stroking and/or kicking is facilitated in a pool area of relatively small dimensions.

The cords are attached to the distal end of the cantilever resistance arm extending outward from the pool deck at the side of the pool over the water to a position above the swimmer and the surface of the water to remain clear of the swimmer's stoke. The cantilever resistance arm is attached at the opposite end to the base on the pool deck as a brace to prevent forward movement. The cords are perpendicular to the bottom of the pool and are attached to the cantilever resistance arm above and a weight setting on the bottom of the pool and held substantially taught between the cantilever resistance arm and the in-pool bottom weight.

It is an objective of the present invention that another embodiment includes a swimming exercise device that can be permanently base mounted to the deck of a swimming pool so as to not be portable or easily transported.

Another objective of the present invention is to provide a swimming exercise device that requires very little space when utilized in a swimming pool and provides minimal interference to other swimmers with the use of the pool.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

In all of the preferred embodiments of the invention the swimmer can swim freely in a confined area of the pool while being held substantially in place, firmly but comfortably by the swimming device, thereby providing casual engagement and resistance during the swimming action, while at the same time accommodating the natural movements of the swimmer. The present invention is particularly useful in small pools where the distance or space is too limited for extensive swimming. It is also useful as an aid in teaching or training persons to swim and can be used in hospitals and other institutions as an exercise and therapy device.

Disclosed as another example is a method of stationary swimming using a stationary swimming device configured with the resistance cords comprising the steps of:

a) positioning the swimmer in the water in front of the device in substantially parallel relation to a central axis of said resistance arm;

b) placing the head of the swimmer between two vertical padded restraining cords;

c) sliding the ball slide block up the lower band until the fit is snug;

d) swimming in a normal manner against the padded resistance cords with the movement of the swimmer towards the wall surface of the swimming pool being restricted.

Disclosed as another example is a method of stationary swimming using a stationary swimming device configured with the stanchion comprising the steps of:

a) positioning the swimmer in the water in front of the device in substantially perpendicular relationship to an axis of the resistance arms;

b) placing the head of the swimmer between the two prongs of the stanchion at the base of the neck;

c) swimming in a normal manner against the stanchion with the movement of the swimmer towards the wall surface of the swimming pool being restricted;

Further, disclosed is a means of providing passive resistance to a swimmer, utilized at the surface plane of the water by casual engagement against both shoulders at the base of the neck, substantially preventing forward motion and restricting the swimmer to a generally stationary position in an area of relatively small dimensions, while allowing the free movement of legs and arms during performance of a swimming action.

In another aspect, the device includes:

a. U-shaped stanchion means configured to conform to the shape of the shoulders;

b. an elongated, arced, rigid resistance arm including a first end and a second end with the first end attached to an abutment means and the second end attached to the stanchion; wherein:

(i) said elongated, arced, rigid resistance arm is configured above the plain of the water so as to not interfere with movement of the user's arms or legs during swimming;

c. said abutment means being disposed on the first end of the resistance arm so as to facilitate, substantially stable, perpendicular abutted engagement of the resistance arm with the vertical wall surface of the swimming pool, so as to prevent forward movement towards the wall surface of the swimming pool by the swimmer swimming engaged with the stanchion in substantially parallel relation to a central axis of said resistance arm;

(i) wherein said abutment means includes a generally T-shaped member structured to be secured to the first end of the resistance arm and extending from both sides of the T-shaped member, in generally perpendicular relation to the elongated, rigid resistance arm, are two cross braces;

(ii) floatation members surrounding and carried on said cross braces secured to opposite ends of the abutment means so as to provide floatation and increased operational stability;

d. a floatation member surrounding and carried on second end of said elongated, arced, rigid resistance arm so as to provide flotation of the swimming exercise, training, and physical therapy device.

In another aspect, the device includes:

a. a substantially rigid U-shaped stanchion frame submerged in the water that rests on the bottom of the pool and uses the side wall of the pool as a brace to prevent forward movement;

(i) the frame extends above and below the swimmer to remain clear of the swimmer's stoke;

(ii) the resistance frame includes a first end and a second end with each end having attachment loops;

(iii) supporting feet disposed laterally at about a 45 degree angle out from both sides of the second end of the resistance frame pointing toward the supporting wall of the swimming pool;

b. two padded cords that removeably connect vertically to the attachment loops of the stanchion frame, that are perpendicular to the bottom of the pool and held substantially taught by the frame.

In another aspect, the device includes:

a. a substantially rigid rectangularly-shaped stanchion frame submerged in the water that rests on the bottom of the pool and uses the side wall of the pool as a brace to prevent forward movement;

(i) supporting feet that extend perpendicularly from both sides of the frame base that hold the frame vertically upright in a swimming pool;

b. substantially rigid resistance members, hinged on the left and right sides of the frame configured in the medial area to conform to the shape of the shoulders;

(i) said resistance members that are equally sized to meet in the center area of the frame at a distance exceeding the outreached stroke of the swimmer so as to remain clear of side of the swimming pool.

In another aspect, the device includes:

a. a rigid C-shaped, generally semi-circular, resistance bow that extends above and below the surface of the water to remain clear of the swimmer's stoke;

(i) the C-shaped resistance bow includes a first end and a second end with each end having attachment loops;

b. a generally horizontal resistance arm attached to the C-shaped resistance bow;

c. a vertical buffer member that extends downward and abuts the side of the swimming pool to prevent forward movement that is attached to the resistance arm;

d. a Y-shaped tripodal resistance base frame that is hinged to the resistance arm with a Clevis bracket;

(i) the Y-shaped tripodal resistance base rests on the pool deck and supports the resistance arm, vertical buffer member, and C-shaped resistance bow;

e. two padded resistance cords that removeably connect vertically to the attachment loops of the C-shaped resistance bow, that are perpendicular to the bottom of the pool and held substantially taught by the C-shaped resistance bow;

f. another embodiment of the current invention that is permanently attaches the resistance base to the deck of a swimming pool.

In another aspect, the device includes:

a. a cantilever resistance arm that extends outward from the pool deck above the surface of the water to remain clear of the swimmer's stoke;

(i) the cantilever resistance arm having a first end and a second end with the first end including a Clevis bracket and the second end attached to a mounting base on the pool deck;

b. the Clevis bracket allows a resistance arm extension to swivel upward, but not forward toward the pool wall;

c. the resistance arm extension includes a plurality of attachment points in sequential relationship to allow for adjustments;

d. attached to the resistance arm is a U-shaped stanchion configured to conform to the shape of the shoulders.

In another aspect, the device includes:

a. a cantilever resistance arm that extends outward from the pool deck above the surface of the water to remain clear of the swimmer's stoke;

(i) the cantilever resistance arm having a first end and a second end with the first end including an attachment loop and the second end attached to a mounting base on the pool deck;

b. an in-pool bottom weight including a second attachment loop setting vertically beneath the first end of the cantilever resistance arm;

c. two padded cords that removeably connect vertically to the attachment loops of the cantilever resistance arm and in-pool bottom weight, that are perpendicular to the bottom of the pool and held substantially taught between the loops.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 7A is a top view of the in-pool frame stanchion 200. FIG. 7B is a front view of the in-pool frame stanchion 200. FIG. 7C is a side view of the in-pool frame stanchion 200.

FIG. 11 is an orthographic projection side view of the permanent pool-side base-mounted cantilever stanchion 400, which is in accordance with another alternative embodiment of the present invention.

FIG. 12A is a side view of the cantilever resistance arm 4101 with the resistance arm extension 430 in a closed or upward position as it would be during the forward swimming action, the Clevis bracket 440, and the U-shaped stanchion 40 (as shown in more detail in FIG. 1).

FIG. 12B is a side view of the cantilever resistance arm 4101 with the resistance arm extension 430 in an open position as it would be as a swimmer pushes upward on the U-shaped stanchion 40 to disengage from the device, the Clevis bracket 440, and the U-shaped stanchion 40 (as shown in more detail in FIG. 1).

Figure 1:
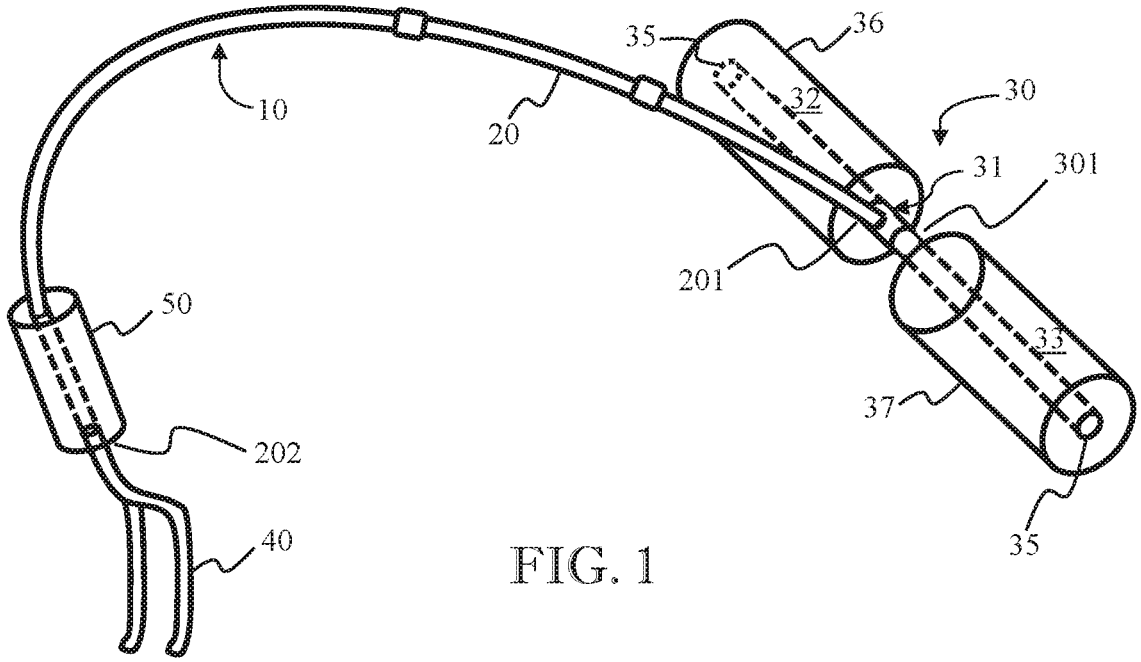
FIG. 1 is a perspective view of the portable in-pool floating stanchion swimming exercise device 10 that is fabricated in accordance with one embodiment of the present invention.

REFERENCE CHARACTERS mounting base 620
U-shaped stanchion 630 (FIG. 14A)
two hinges 640
downward extension bars 650
soft, resilient cover pads 660

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

1. Portable In-Pool Floating Stanchion Device

Shown in FIG. 1, the present invention is directed towards a swimming exercise device indicated as 10. The device illustrated in the drawings constitutes one of the possible embodiments of the invention. The exercise device 10 is structured to confine a user to a small section of a swimming pool, while still allowing them to enjoy the excellent cardiovascular aerobic benefits of swimming. Further, the exercise device 10 is structured for use inside a conventional above-ground or in-ground type swimming pool, which includes at least one generally vertical wall surface, without requiring any adaptation or obstruction of the exterior of the swimming pool or any fixed utility items associated with the swimming pool's use.

Figure 2:
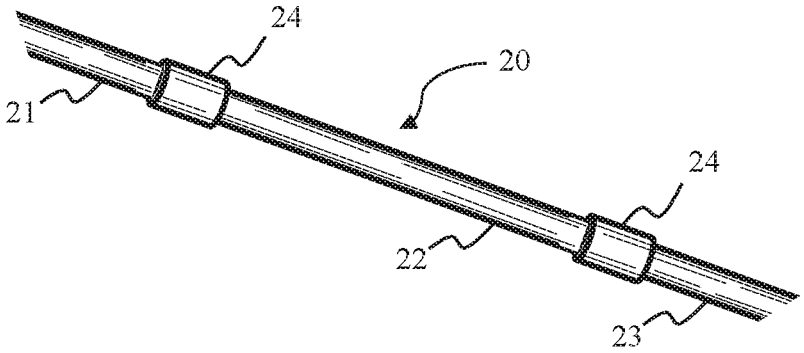
FIG. 2 is a perspective view of the plurality of interlocking tubular members 21, 22, and 23 of the rigid resistance arm 20.

The exercise device 10 includes a generally narrow, elongated, rigid resistance arm 20. The resistance arm 20, which includes a first end 201 and a second end 202, preferably constructed of lightweight plastic, rigid vinyl, PVC, or another strong, yet lightweight material. Further, in the preferred embodiment, the elongated, rigid resistance arm 20 includes at least one, but preferably a plurality of interlocking tubular members 21, 22, and 23 as shown in FIG. 2. The interlocking tubular members, 21, 22, and 23, which are each constructed of the strong, yet lightweight material, are structured to be removeably secured with one another so as to define the single elongated, rigid resistance arm 20.

Although it is understood that the tubular members 21, 22, and 23 may be removeably secured with one another in a variety of manners, in the preferred embodiment the tubular members 21, 22, and 23, are removeably connected together by segment connectors 24. The segment connectors 24, which may be integrally formed as part of an end of one or more of the tubular members, or may be separately secured with tubular members 21, 22, and 23, are preferably female, increased diameter sockets that receive either a tapered or normal sized male end of the tubular members. Additionally, while generally the fitted interlocking connection between the sized male and female portions is sufficient to maintain secure engagement, especially because a swimmer's movement is directed towards further compressing/interlocking the tubular segments with one another, in an alternate embodiment, the segment connectors 24 may be threaded on the inside, and each of the tubular members 21, 22, and 23, includes a threaded exterior at its interlocking end. As such, a more secure interlocked engagement is achieved, and in the case of the separate segment connectors 24, each can receivably join tubular members 21, 22, or 23 of the resistance arm 20 with one another.

Further, the length of the aforementioned tubular members 21, 22, and 23 may be varied to provide for a larger or smaller resistance arm 20 that is conveniently useable by children or taller individuals. Alternatively, use of the swimming exercise device by children or taller individuals may be facilitated simply by selectively removing or adding one or more of the tubular members to define the elongated, rigid resistance arm 20. Moreover, by having the segment connectors 24 identically configured, the elongated, rigid resistance arm 20 can be assembled in a variety of permutations, especially if one or more of the tubular members are of different sizes from one another.

The swimming exercise device 10 of the present invention also includes abutment means 30. Specifically, abutment means 30 is to be disposed on the first end 201 of the resistance arm 20 so as to facilitate substantially stable, perpendicular abutted engagement of the resistance arm 20 with the wall surface of the swimming pool. Accordingly, through the abutted engagement of the resistance arm 20 with the wall surface, movement of the resistance arm 20 towards that wall surface is prevented and a user engaged at the second end 202 of the resistance arm, as will be described subsequently, and swimming towards the abutment means 30 at the wall surface, remains substantially stationary while engaging in swimming exercises.

Included as part of the abutment means 30, and secured at the first end 201 of the resistance arm 20, is a generally T-shaped member 301. As with the tubular members, the T-shaped member 301 is structured to be removeably linked so as to provide for secure interconnection as well as convenient disassembly and storage. The T-shaped member 301 may be a single element, in the preferred embodiment, or the T-shaped member 301 may be made up of a number of detachable, interlocking segments. A first of these segments of the T-shaped member 301 includes a T-Connector 31. Much like the resistance arm 20, the T-Connector 31 and the remaining interlocking segments of the T-shaped member 301 are preferably constructed of lightweight plastic, rigid vinyl, PVC, or another similar strong, yet lightweight material. The T-Connector 31 is structured to be secured to the first end 201 of the resistance arm 20 in much the same manner as the tubular segments 21, 22, and 23 are removeably secured with one another, and may similarly include a threaded interconnection socket structured to receive a corresponding tubular segment 21.

Further included as part of the T-shaped member 301 and extending from both sides of the T-Connector 31, in generally perpendicular relation to the elongated, rigid resistance arm 20, are two cross braces 32 and 33. These cross braces 32 and 33 are preferably short tubular segments similar to the tubular segments 21, 22, and 23 that make up the elongated, rigid resistance arm 20, and in fact may be structured to be interchangeable therewith, depending upon the needs of the user. Both ends of the cross braces 32 and 33 may be threaded on the outside or are specifically sized, so they may extend into secured engagement within the T-connector 31. Alternatively, the cross braces 32 and 33 may consist of a single continuous tubular member that goes through the T-Connector 31. Additionally, attached to the outer ends of the cross braces 32 and 33 are end caps 35.

Surrounding and carried on said cross braces 32 and 33 so as to provide floatation and increased operational stability, illustrated in the figures, there are floatation members 36 and 37, removeably secured to opposite ends of the abutment means 30. As such, the increased surface area of the floatation members 36 and 37 are structured to provide a stable point of engagement between the relatively narrow resistance arm 20 and the wall surface of the swimming pool, thereby helping to maintain the generally perpendicular, operational orientation of the resistance arm 20 relative to the wall surface when the user is swimming.

It will be appreciated that the entire abutment means 30 does not have to be completely dis-assembled for transport or storage. Rather, significant portability is achieved by simply detaching the resistance arm 20 from the T-connector 31. As such, the remainder of the abutment means 30 is preferably left intact, and indeed the various parts such as the cross braces 32 and 33 may even be permanently joined together.

Disposed opposite the abutment means 30, at the second end 202 of the resistance arm 20 is the U-shaped stanchion 40. The stanchion means 40 is structured to provide casual resistance of the user to the swimming exercise device 10 at the second end 202 of the elongated, rigid resistance arm 20. The second end 202 of the elongated, rigid resistance arm 20, as has been previously described, may be threaded to provide for effective interconnection, but nevertheless is removeably joined with a stanchion 40. In the preferred embodiment, the stanchion 40 is constructed of a lightweight plastic, rigid vinyl, PVC, or other similar material and may be formed into a single molded piece. Further, one end of the stanchion 40 may be threaded, or otherwise sized/fitted on the inside to removeably join with the second end 202 of the elongated, rigid resistance arm 20.

The stanchion 40 extends downward in a U-shaped substantially vertical direction. This vertical configuration does not interfere with movement of the user's arms or legs during swimming. In particular, the vertical portion of the stanchion 40 terminates in a U-shape, and in the preferred embodiment, the stanchion 40 includes a single piece that forms both the bend and the U-shape therein.

To provide comfort to the user, the stanchion 40 is preferably provided with a soft, resilient pad. As such, a user swimming against the stanchion 40 will not contact a rough, rigid surface.

Also in the preferred embodiment, the stanchion means 40 of the swimming exercise device 10 is provided with a floatation member 50. The floatation member 50, which is constructed of a generally soft, resilient, buoyant material such as polyurethane foam or air cell, is designed to conformably fit around the second end 202 of the resistance arm.

It is therefore appreciated that during use, an individual will casually engage with the stanchion means against both of their shoulders at the base of the neck, and will engage the abutment means 30 with the vertical wall surface. At that point, the individual will begin swimming under the resistance arm 20 with their torso extending away from the stanchion means 40. Accordingly, during use, as the body of the individual is aligned with the resistance arm 20, the arms during a conventional forward stroke pass freely under the resistance arm 20 without engagement. Furthermore, the overall length of the resistance arm 20 is longer than a length of the outreached arm of the user.

REFERENCE CHARACTERS swimming exercise device 10
first end 201 and second end 202 of the rigid resistance arm 20
preferably a plurality of interlocking tubular members 21, 22, and 23
segment connectors 24
abutment means 30
T-shaped member 301
T-Connector 31
two cross braces 32 and 33
end caps 35
floatation members 36 and 37
U-shaped stanchion 40
floatation member 50

2. In-Pool Frame with Bands Device

Figure 3:
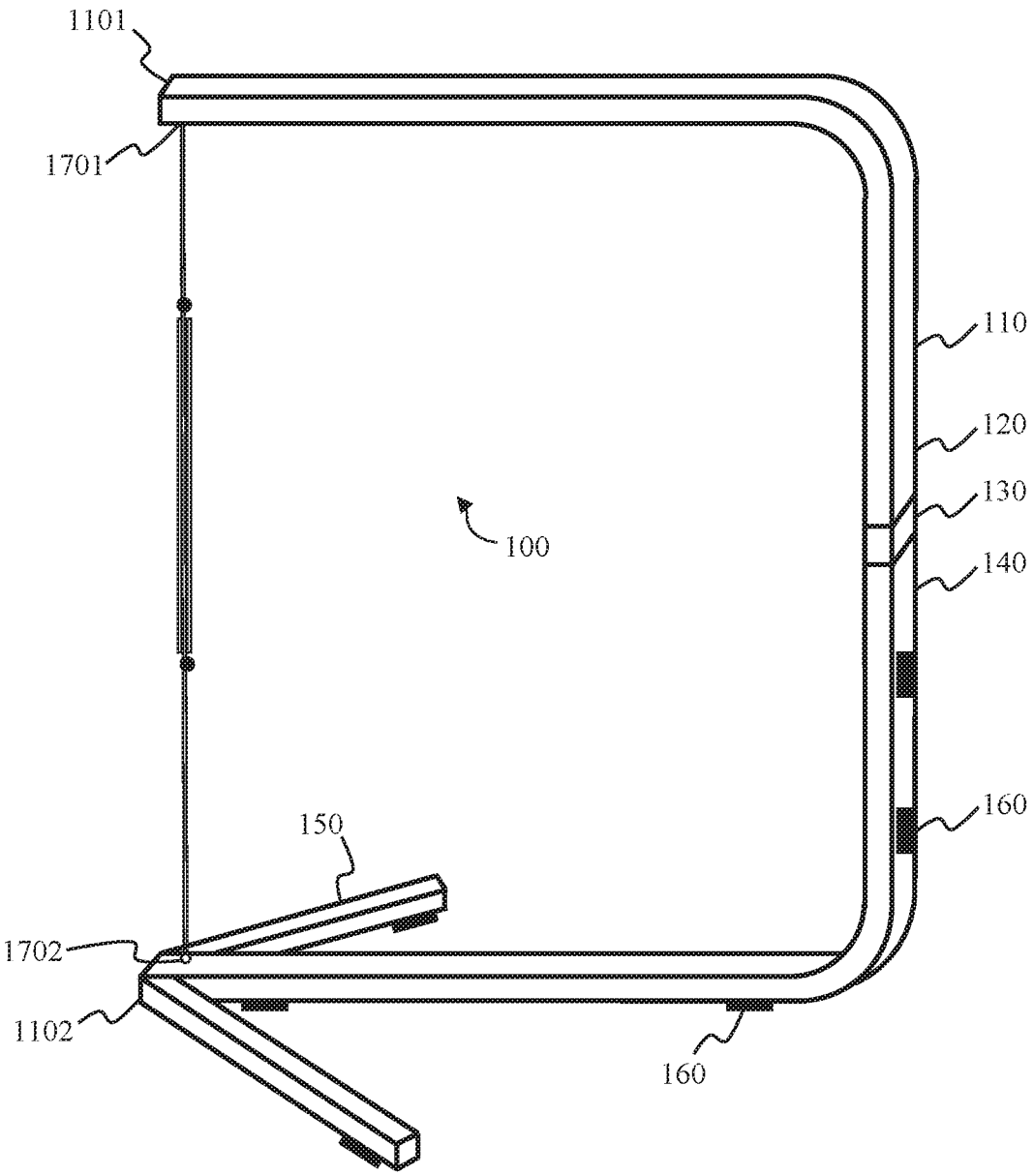
FIG. 3 is a perspective view of the in-pool frame with bands device 100 in accordance with another alternative embodiment of the present invention.

In the perspective view shown in FIG. 3, the present invention is directed towards a swimming exercise device indicated as 100. The device illustrated in the drawings constitutes one of the possible embodiments of the invention. The exercise device 100 is structured to confine a user to a small section of a swimming pool, while still allowing them to enjoy the excellent cardiovascular aerobic benefits of swimming. Further, the exercise device 100 is structured for use inside a conventional above-ground or in-ground type swimming pool, which includes at least one generally vertical wall surface, without requiring any adaptation or obstruction of the exterior of the swimming pool or any fixed utility items associated with the swimming pool's use.

The exercise device 100 includes primarily a rigid U-shaped resistance frame 110. The resistance frame 110, which includes a first end 1101 and a second end 1102, preferably includes an elongated tube that will not obstruct a swimmer utilizing the exercise device 100 with axial alignment therewith. Accordingly, through the abutted engagement of the exercise device 100 with the wall surface, movement of the resistance frame 110 towards that wall surface is prevented and a user engaged at the distal ends of the resistance frame 110, as will be described subsequently, swimming towards the wall surface, will remain substantially stationary while engaging in swimming exercises.

Preferably, the rigid resistance frame 110 is constructed of non-rusting metal such as an aluminum alloy or stainless steel, or another strong material, such as carbon fiber that is weighted sufficiently enough to stay stationary on the bottom of the swimming pool during use. Further, in the preferred embodiment, the U-shaped resistance frame 110 includes at least one, but preferably a plurality of interlocking tubular members 120, 130, and 140. The interlocking tubular members, 120, 130, and 140, which are each constructed of the strong material, are structured to be removeably secured with one another so as to define the single elongated, rigid U-shaped resistance frame 110, thus allowing more convenient shipping and storage.

Although it is understood that the tubular members 120, 130, and 140 may be removeably secured with one another in a variety of manners, in the preferred embodiment the tubular members 120, 130, and 140, are removeably connected together by integrally formed male and female segments as part of an ends of one or more of the tubular members, having a socket that receives a tapered male end of the tubular members sufficient to maintain secure engagement. In an alternate embodiment, the segments may be bolted together. As such, a more secure interlocked engagement is achieved.

Further, the length or the number of the aforementioned tubular members 120, 130, and 140 may be varied by selectively removing or adding one or more of the tubular members to provide for a taller or shorter resistance frame 110 that is conveniently adapted to varying pool depths. The swimming exercise device 100 of the present invention also includes supporting feet 150. Specifically, the supporting feet 150 are to be disposed laterally on the second end 1102 of the resistance frame 110, so as to facilitate substantially stable, diagonal, abutted engagement with the resistance frame 110 providing stability with the bottom surface of the swimming pool. The supporting feet 150 are bolted or welded on both sides of the resistance frame 110 at about a 45 degree angle out from the second end of the resistance frame 110 pointing toward the supporting wall of the swimming pool. Included on the bottom and back of the resistance frame 110 and the bottom of the supporting feet 150 are soft bumpers 160 to cushion the resistance frame 110 and supporting feet 150 from the bottom and wall of the swimming pool.

Figure 4A:
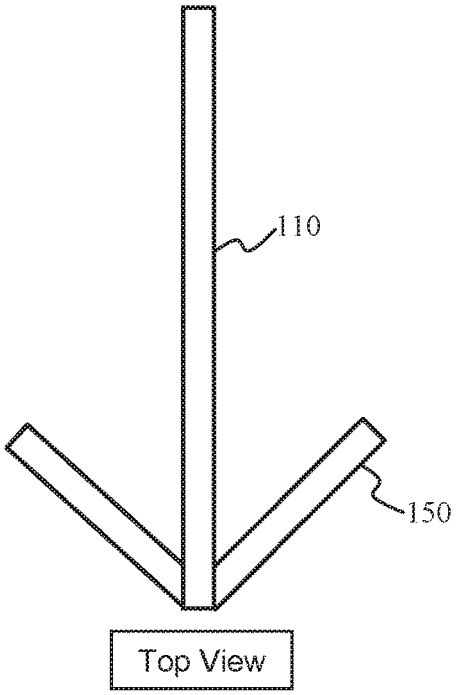
FIG. 4A is an orthographic projection top view of the in-pool frame with bands device 100 in accordance with another alternative embodiment of the present invention, which is the same configuration as FIG. 3.
Figure 4B:
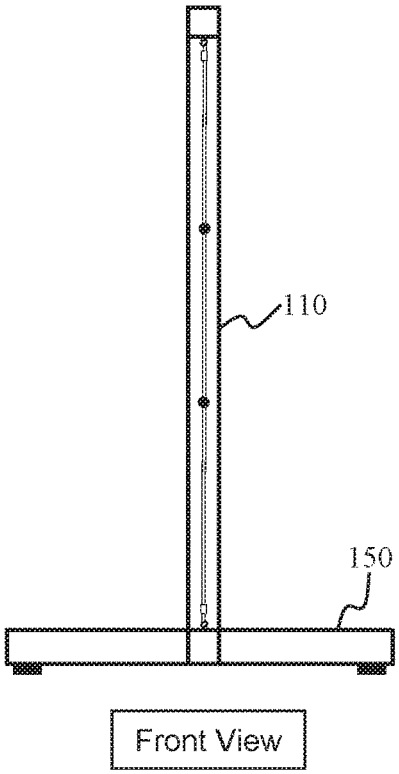
FIG. 4B is a front view of that same in-pool frame with bands device 100 as FIG. 3.
Figure 4C:
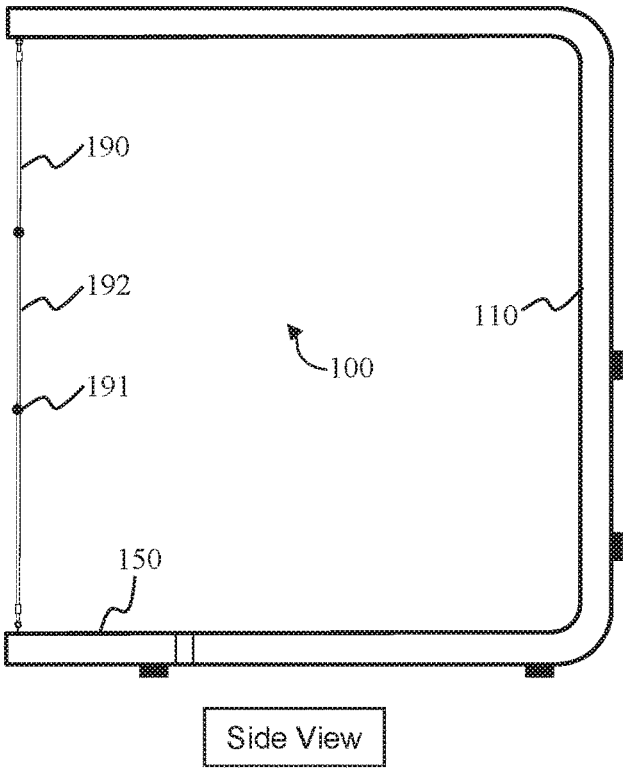
FIG. 4C is a side view of that same in-pool frame with bands device 100 as FIG. 3.

FIG. 4A is a top view of the swimming exercise device 100. FIG. 4B is a front view of the swimming exercise device 100. FIG. 4C is a side view of the swimming exercise device 100.

Figure 5:
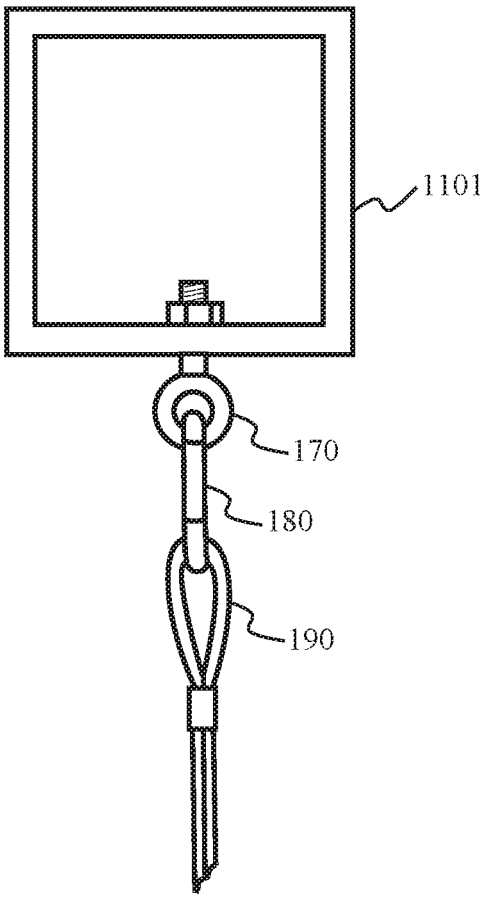
FIG. 5 is an orthographic projection of the end of the resistance frame 1101, the metal loops or eyelets 170 for removeably attaching carabiners 180 that connect the two resistance cords 190 to the resistance frame 110.

At both ends of the resistance frame 1101 and 1102 are metal loops or eyelets 170 for removeably attaching carabiners 180 that connect the two padded resistance cords 190 to the resistance frame 110. As shown in FIG. 5, the top eyelet 1701 is attached pointing downward from the resistance frame 1101, while the bottom eyelet 1702 is attached pointing upward from the resistance frame 1102. The resistance cords 190 can be held taught by attachment at the top or bottom to one of the various links in a coated chain, then decreasing the number of links between that connection and the connection with the metal loops or eyelets 170 at the top or bottom (first end 1101 or second end 1102) of the resistance frame 110. A more detailed view of the eyelet arrangement is shown in FIG. 5.

Figure 6:
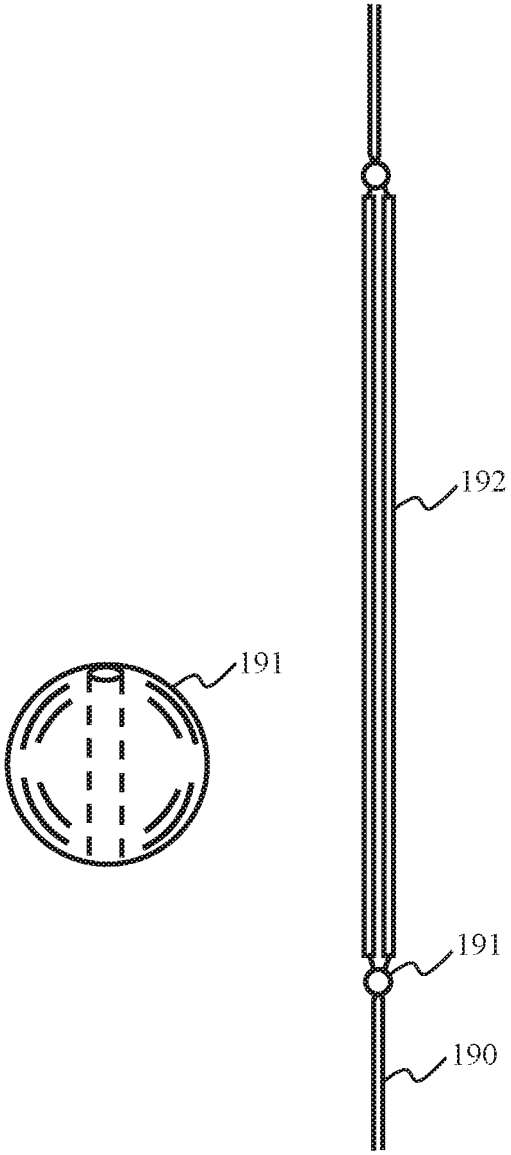
FIG. 6 is an orthographic projection of the two resistance cords 190 that are adjustable by sliding the slide balls or blocks 191 up and down, and the cushioning vinyl tubing covers 192.

A more detailed view of the two padded resistance cords 190 is shown in FIG. 6. The two padded resistance cords 190 are held vertically taught at these anchoring points. The two resistance cords 190 may be made from polyester cord or similar material. Surrounding the medial area of the resistance cords 190 are pads of cushioning vinyl tubing 192, or the like, that cover and soften the feel of the resistance cords 190 to the swimmer's shoulders. The two side by side resistance cords 190 are held closely together by either insertion in a center hole of the two slide balls or insertion into side by side holes in two slide blocks 191 and the opening between the two padded resistance cords 190 can be adjusted by sliding the slide balls or blocks 191 up and down. To perform the swimming exercise, the swimmer adjusts the slide balls or blocks 191 up and down to make the opening larger or smaller, inserts their head, adjusts the slide ball or block 191 up and down to make the opening larger or smaller in order to create a comfortable and secure position of the resistance cords 190 on the shoulders, and then begins swimming toward the wall of the swimming pool, being held substantially in place by the resistance cords 190.

REFERENCE CHARACTERS swimming exercise device 100
first end 1101 and a second end 1102 of U-shaped resistance frame 110
plurality of interlocking tubular members 120, 130, and 140
supporting feet 150
soft bumpers 160
metal loops or eyelets 170
carabiners 180
resistance cords 190
slide ball or block 191
cushioning vinyl tubing covers 192

3. In-Pool Frame Stanchion

Figure 7A:
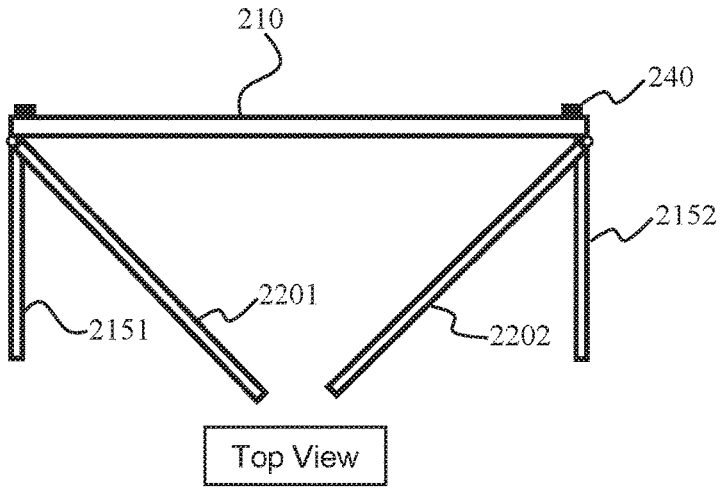
FIGS. 7A, 7B and 7C are orthographic projections of the in-pool frame stanchion configuration 200, which is in accordance with another alternative embodiment of the present invention.
Figure 7B:
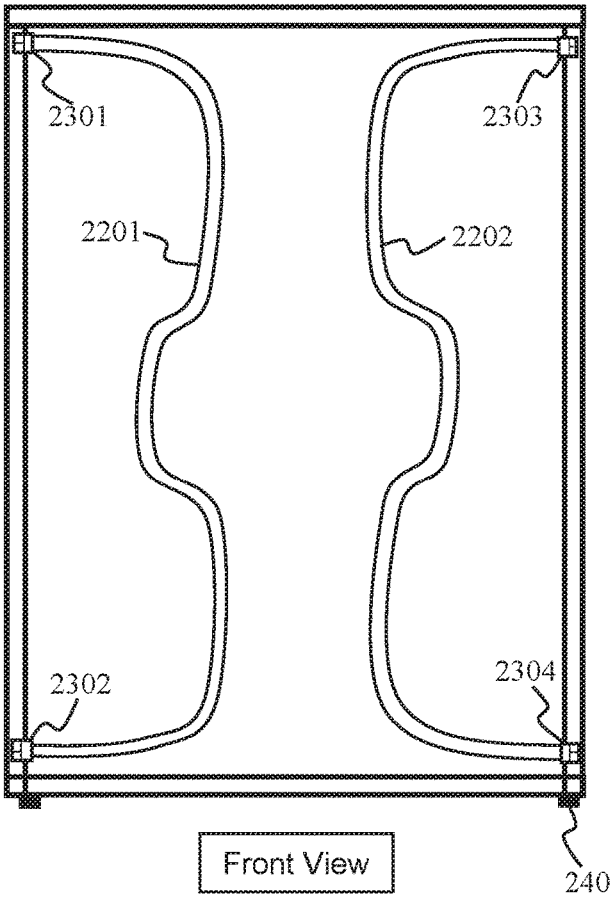
Figure 7C:
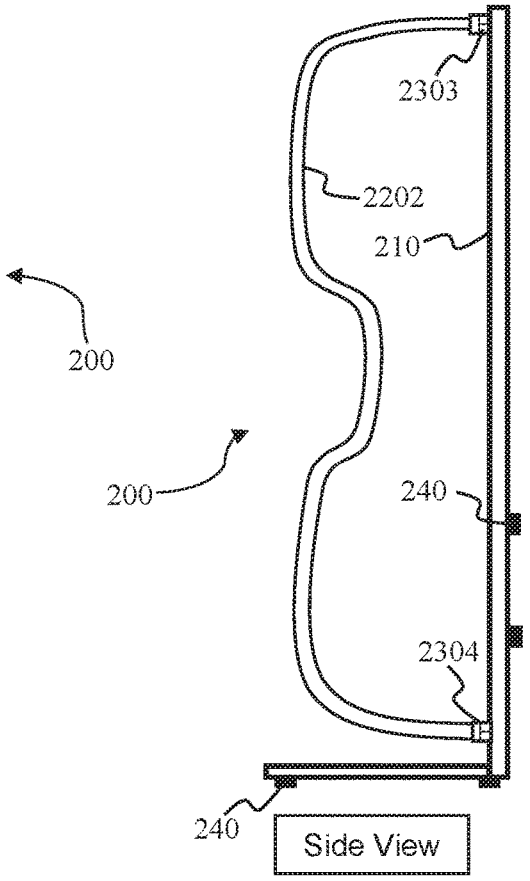

Shown in FIG. 7A, FIG. 7B, and FIG. 7C, the present invention is directed towards a swimming exercise device indicated as 200. The device illustrated in the drawings constitutes one of the possible embodiments of the invention. The exercise device 200 is structured to confine a user to a small section of a swimming pool, while still allowing them to enjoy the excellent cardiovascular aerobic benefits of swimming. Further, the exercise device 200 is structured for use inside a conventional above-ground or in-ground type swimming pool, which includes at least one generally vertical wall surface, without requiring any adaptation or obstruction of the exterior of the swimming pool or any fixed utility items associated with the swimming pool's use.

The exercise device 200 includes primarily a tubular frame 210 that stands vertically in a swimming pool, held firmly upright by supporting feet 215 to the left (facing the device) 2151 and to the right 2152. The rigid resistance members 220, which includes one to the left (facing the device) 2201 and to the right 2202, preferably includes a generally narrow, elongated tube configured in a curved way to provide a comfortable stanchion resistance on the shoulders at the base of the neck against the device and the wall of the swimming pool that will not obstruct a user utilizing the exercise device and swimming between in generally perpendicular alignment therewith. Preferably, the elongated, rigid, resistance members 220 are constructed of non-rusting metal such as an aluminum alloy or stainless steel, or another strong yet lightweight material, such as carbon fiber, plastic, rigid vinyl, or PVC. To provide comfort to the user, the stanchions 2201 and 2202 are preferably provided with a soft, resilient cover pad. As such, a user while swimming against the stanchions 2201 and 2202 will contact a soft and smooth surface.

Further, in the preferred embodiment, the elongated, rigid resistance members 220 includes a plurality of hinges 2301, 2302, 2303 and 2304 as shown in FIG. 7B. The hinges 2301, 2302, 2303 and 2304 allow the resistance members 2201 and 2202 to open and close to allow swimmers to position themselves in the front and center of exercise device 200 and swim with normal strokes while being held substantially in place by the resistance members 2201 and 2202. Via the hinges 2301, 2302, 2303 and 2304, the resistance members 220 may be variably angled relative to the frame 210, which in some examples may be leveraged to vary a size of the opening defined by the opposing arrangement of the resistance members 220 and through which a user inserts his or her head to engage and use the exercise device 200. Included on the bottom and back of the resistance frame 210 and the bottom of the supporting feet 2151 and 2152 are soft bumpers 240 to cushion the resistance frame 210 and supporting feet 2151 and 2152 from the bottom and wall of the swimming pool.

It is therefore appreciated that during use, an individual will casually engage with the stanchion means against both of their shoulders at the base of the neck, and will engage the resistance frame 210 with the vertical wall surface. At that point, the individual will begin swimming against the resistance members 2201 and 2202 with their torso extending way from the resistance members 2201 and 2202. Furthermore, the overall length of the resistance members 2201 and 2202 from the wall of the swimming pool is greater than a length of the outreached arm of the user. Accordingly, during use, as the body of the individual is perpendicularly aligned with the resistance members 2201 and 2202, their arms during a conventional forward stroke pass freely beside the resistance members 2201 and 2202 without engagement.

REFERENCE CHARACTERS exercise device 200
tubular resistance frame 210
resistance members 2201 and 2202
supporting feet 2151 and 2152
resistance member hinges 2301, 2302, 2303 and 2304
soft bumpers 240

4. Permanent Pool-Side Base Mounted Bow

Figure 8:
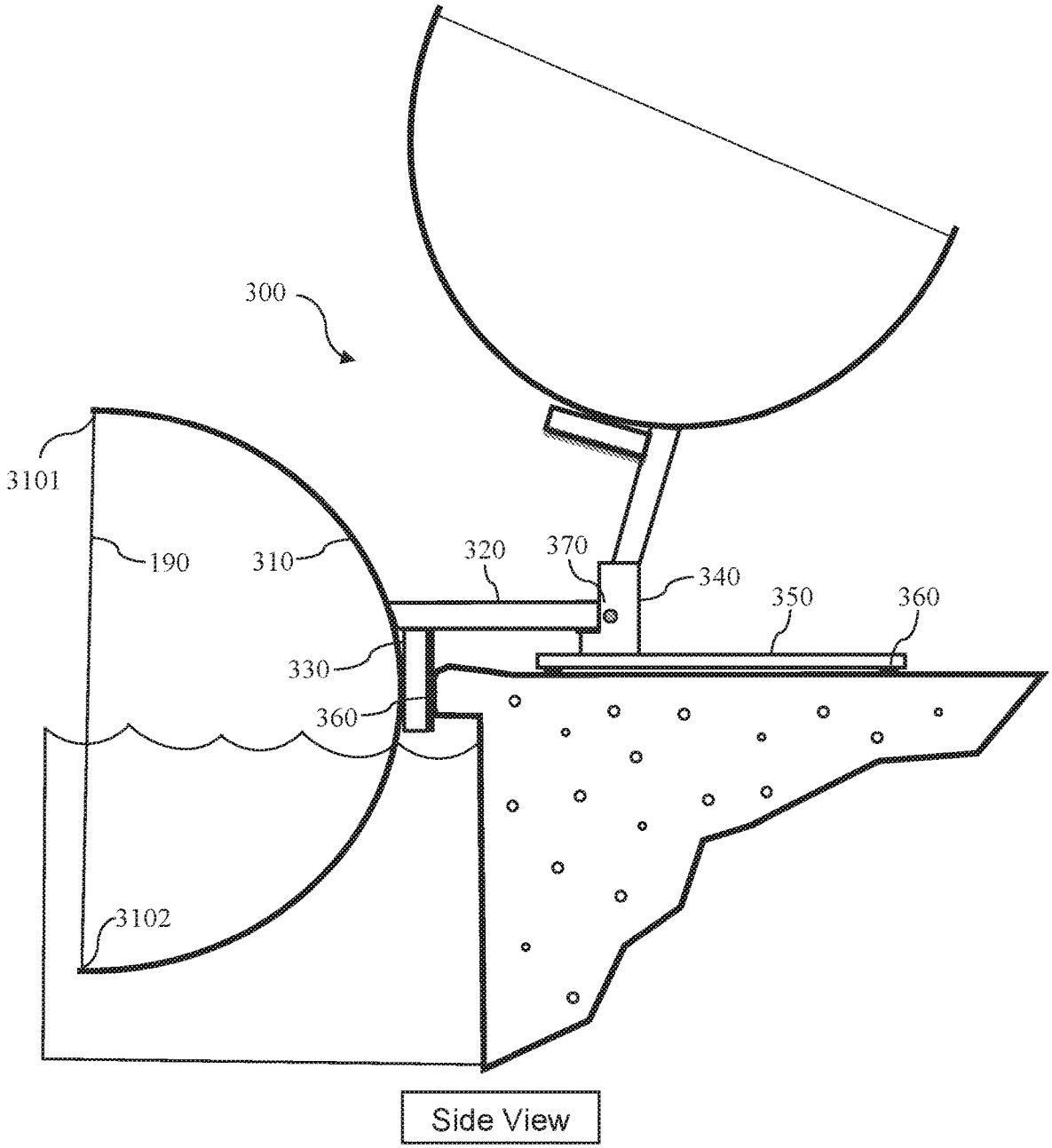
FIG. 8 is an orthographic projection of the permanent pool-side base-mounted bow configuration 300, which is in accordance with another alternative embodiment of the present invention.
Figure 10:
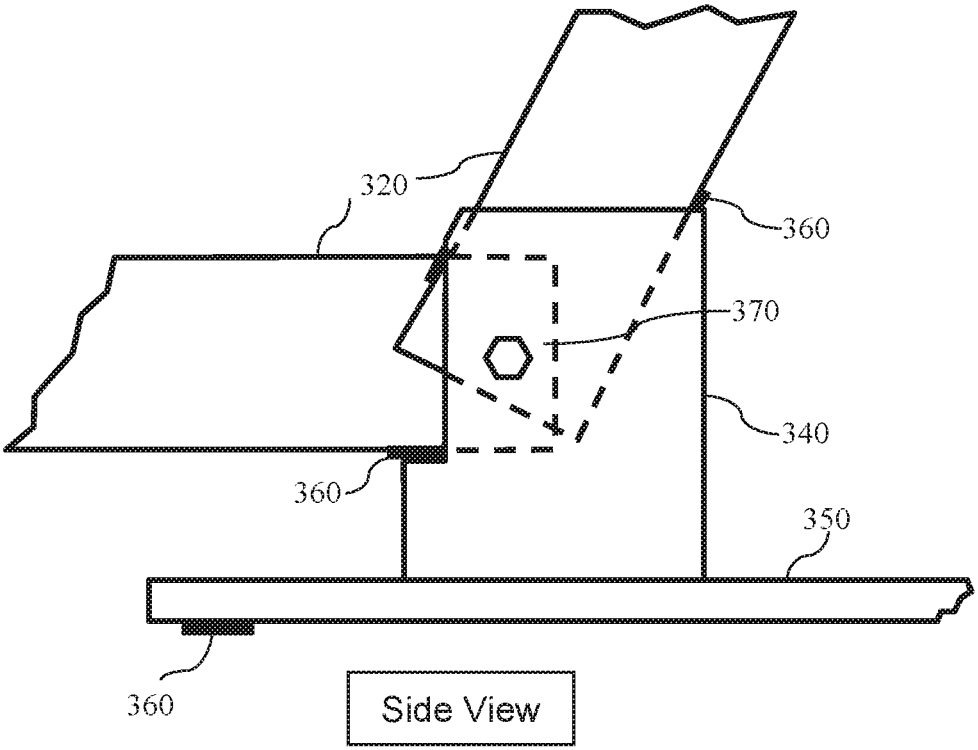
FIG. 10 is a side view of the permanent pool-side base-mounted bow configuration 300, showing the horizontal resistance arm 320 in two positions that is hinged with a Clevis bracket 370, on a resistance base frame 340, that is bolted or welded to a Y-shaped tripodal base 350 that rests on the pool deck. The tripodal base 350 has skid-resistant feet 360 to add support against movement.

FIG. 8—In the case of a pool made of concrete or other strong material, the device can be mounted on or firmly attached in some suitable manner to the pool deck itself. Another embodiment of the instant invention is a deck-mounted device that restrains the swimmer against both shoulders at the base of the neck with two padded resistance cords 190. The cords are attached to a C-shaped, generally semi-circular, resistance bow 310 that is attached to a generally horizontal resistance arm 320 that is hinged with a Clevis bracket 370 (as shown in FIG. 10) on a resistance base frame 340 that is bolted or welded to a Y-shaped tripodal base 350 that rests on the pool deck. The tripodal base 350 has skid-resistant feet 360 to add support against movement. Attached to the resistance arm 320 is a generally vertical buffer member 330 that extends downward and abuts the side of the swimming pool to prevent forward movement. The hinge on the resistance base frame 340 allows the resistance arm to swivel up for easier attachment and detachment of the resistance cords 190 to the C-shaped resistance bow 310 while out of the water at the edge of the swimming pool. The C-shaped resistance bow 310 extends above and below the swimmer and the surface of the water to remain clear of the swimmer's stoke. The resistance cords 190 (as shown in FIG. 6) are perpendicular to the bottom of the pool and held substantially taught by the C-shaped resistance bow 310.

The resistance bow 310 includes a first end 3101 and a second end 3102, preferably consisting of a rectangular, elongated tube that will not obstruct a swimmer utilizing the exercise device 300 with axial alignment therewith. At both ends of the resistance bow 3101 and 3102 are metal loops or eyelets 170, as shown in FIG. 5, for removeably attaching carabiners 180 that connect the two padded resistance cords 190 to the resistance bow 310. As shown in FIG. 5, the top eyelet 1701 is attached pointing downward from the resistance bow 3101, while the bottom eyelet 1702 is attached pointing upward from the resistance bow 3102. The resistance cords 190 can be held taught by attachment at the top or bottom to one of the various links in a coated chain, then decreasing the number of links between that connection and the connection with the metal loops or eyelets 170 at the top or bottom (first end 3101 or second end 3102) of the resistance bow 310.

Figure 9:
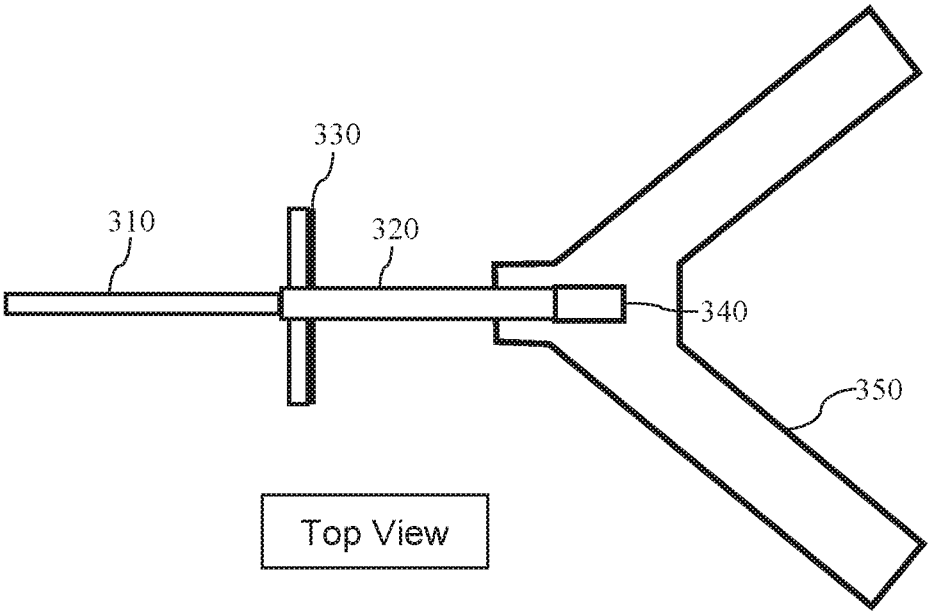
FIG. 9 is a top view of the permanent pool-side base-mounted bow configuration 300 showing exercise device 300, the C-shaped resistance bow 310, the resistance arm 320, buffer member 330, and the Y-shaped base 350.

Attached to the back side of the buffer member is a skid-resistant soft bumper 360, as well as the bottom of the Y-shaped tripodal base (as shown in FIG. 9). Accordingly, through the abutted engagement of the exercise device 300 with the wall surface, movement of the exercise device 300 towards that wall surface is prevented and a user engaged within the two padded resistance cords 190 on the shoulders at the base of the neck while swimming towards the wall surface, will remain substantially stationary while engaging in swimming exercises.

Preferably, the rigid C-shaped resistance bow 310, resistance arm 320, buffer member 330, base frame 340, and Y-shaped tripodal base 350 are constructed of non-rusting metal such as an aluminum alloy or stainless steel, or another strong material, such as carbon fiber that is weighted sufficiently enough to stay stationary at the edge of the swimming pool during use.

It is an objective of the present invention that another embodiment includes a swimming exercise device that can be permanently base mounted to the deck of a swimming pool so as to not be portable or easily transported.

Another objective of the present invention is to provide a swimming exercise device that requires very little space when utilized in a swimming pool and provides minimal interference to other swimmers with the use of the pool.

An additional objective of the present invention is to provide a swimming exercise device that does not require any attachment to the swimmer and can be easily utilized to hold the swimmer in a desired position during usage.

An additional objective of the present invention is to provide a swimming exercise device whereby the user may quickly and easily be released from the device in case of an emergency such as chocking while taking in water, a muscle cramp, heart palpation, asthma attack, etc.

Another objective of the present invention is to provide a swimming exercise device that may be used with or without a floatation aid so that it adapts to the skill, experience, and agility of the user.

It is a further objective of the present invention to provide a swimming exercise device that reduces the user from being distracted by other swimmers and offers the user significant privacy by allowing him/her to face the wall of the swimming pool while exercising rather than looking out into a crowd of other swimmers.

It is a further objective of the present invention to provide a swimming exercise device that permits the swimmer to swim freely and as hard as they wish, with whatever stroke and in whatever position they wish, and yet be confined to a limited area in the water.

It is also an objective of the present invention to provide a swimming exercise device that can be utilized in a wide variety of pool depths.

Yet another objective of the present invention is to provide a swimming exercise device that can easily be swiveled out of the water when not in use in order to maintain the cords.

Another embodiment includes a base of a substantially tripodal configuration, including skid-resistant feet on the deck of a water-filled pool.

REFERENCE CHARACTERS exercise device 300
C-shaped resistance bow 310
resistance arm 320
buffer member 330
resistance base frame 340
Y-shaped base 350
soft bumpers 360
Clevis bracket 370
metal loops or eyelets 170
carabiners 180
resistance cords 190
slide ball or block 191
vinyl tubing covers 192

5. Permanent Pool-Side Base-Mounted Cantilever Stanchion

Shown in FIG. 11, another embodiment of the instant invention is a deck-mounted device indicated as 400 that restrains the swimmer against both shoulders at the base of the neck with a stanchion, structured to confine a user to a small section of a swimming pool, while still allowing them to enjoy the excellent cardiovascular aerobic benefits of swimming. In the case of a pool made of concrete or other strong material, the device can be mounted on or firmly attached in some suitable manner to the pool deck itself. The device illustrated in the drawings constitutes one of the possible embodiments of the invention. The stanchion is attached to a cantilever resistance arm extending outward from the pool deck at the side of the pool over the water to remain clear of the swimmer's stoke.

The exercise device 400 includes primarily an elongated, cantilever resistance arm 410. The resistance arm 410, which includes a first end 4101 and a second end 4102, preferably includes an elongated tube or truss that is sufficiently long enough that the swimmer's outreached arm will not contact the side wall of the swimming pool and high enough above the water that it will not obstruct the swimmer utilizing the exercise device and swimming thereunder in axial alignment therewith.

At the first end 4101 of the cantilever resistance arm 410 is a Clevis bracket 440 that allows a resistance arm extension 430 to swivel upward, but not forward toward the pool wall. At the opposite end of the cantilever resistance arm 410 is a mounting base 420 configured for secure engagement to a pool deck by appropriate known methods in the art. Attached to the resistance arm extension 430 is a U-shaped stanchion 40. The stanchion means 40 is structured to provide casual resistance to the user of the swimming exercise device 400. The U-shaped stanchion 40 extends with the open end downward in a configuration adapted to receive a swimmer's head against both shoulders at the base of the neck with sufficient pressure during the swimming action for maintaining there between a mated relationship providing resistance in a manner such that uninterrupted stroking and/or kicking is facilitated in a pool area of relatively small dimensions.

The end of the resistance arm extension 430 may be threaded to provide for effective interconnection, but nevertheless is removeably joined with a stanchion 40. In the preferred embodiment, the stanchion 40 is constructed of a lightweight plastic, rigid vinyl, PVC, or other similar material and may be formed into a single molded piece. Further, one end of the stanchion 40 may be threaded, or otherwise sized/fitted on the inside to removeably join with the resistance arm extension 430.

FIG. 12A shows the resistance arm extension in a closed or upward position against the cantilever resistance arm 410 that restrains the forward movement of the swimmer as they swim toward the wall of the swimming pool. FIG. 12 B shows the resistance arm extension in an open or downward position against the cantilever resistance arm 410 that would allow the swimmer to disengage with the U-shaped stanchion 40 and the exercise device 400. The resistance arm extension 430 of the present invention also includes a soft bumper 450 and a plurality of attachment points in sequential relationship to allow for adjustments. The cantilever resistance arm 410 is bolted or welded to the mounting base 420. The shape of the cantilever resistance arm 410 is a convex arc upward wherein the angle formed between the tangent of the arm and the water surface decreases gradually as one travels from the mounting base 420 of the cantilever resistance arm 410 to the top portion of the arm away from the base. For example, near the bottom portion of the arm the angle may be at least 60 or 80 degrees and near the top portion of the arm the angle may be no less than parallel, or minus 20 degrees.

REFERENCE CHARACTERS exercise device 400
first end 4101 and second end 4102 of cantilever resistance arm 410
mounting base 420
resistance arm extension 430
Clevis bracket 440
U-shaped stanchion 40 (FIG. 1)

6. Permanent Pool-Side Base-Mounted Cantilever with In-Pool Bottom Weight

Figure 13:
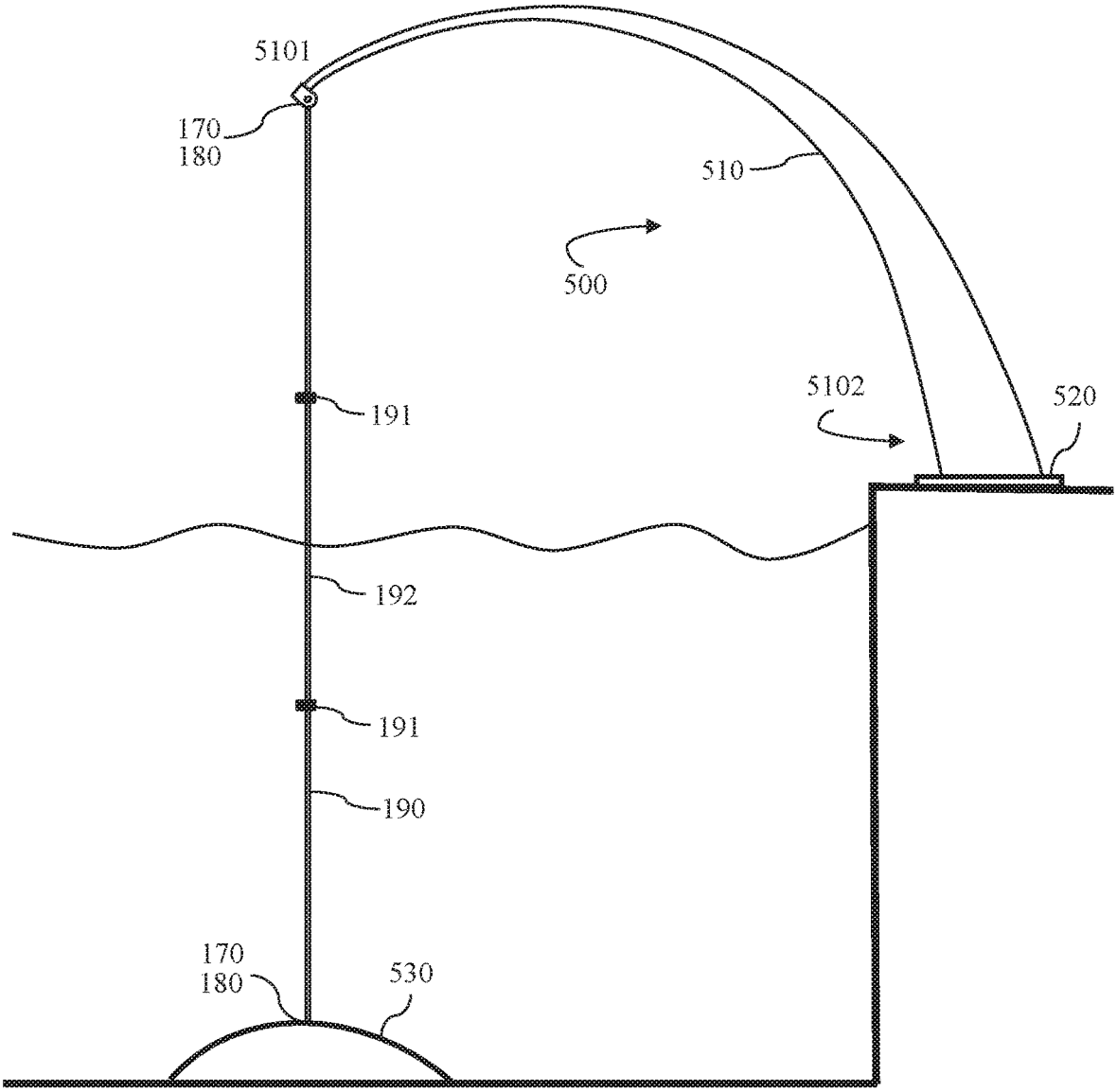
FIG. 13 is an orthographic projection side view of the permanent pool-side base-mounted cantilever with in-pool bottom weight 500, which is in accordance with another alternative embodiment of the present invention.

Shown in FIG. 13, another embodiment of the instant invention is a deck-mounted device indicated as 500 that restrains the swimmer against both shoulders at the base of the neck with resistance cords 190 (as shown in more detail in FIG. 6), structured to confine a user to a small section of a swimming pool, while still allowing them to enjoy the excellent cardiovascular aerobic benefits of swimming. In the case of a pool made of concrete or other strong material, the device can be mounted on or firmly attached in some suitable manner to the pool deck itself. The device illustrated in the drawings constitutes one of the possible embodiments of the invention. The resistance cords 190 are attached to a cantilever resistance arm 510 extending outward from the pool deck at the side of the pool over the water to a position above the shoulders of the swimmer while in use to remain clear of the swimmer's stoke. The resistance cords 190 (as shown in FIG. 6) are perpendicular to the bottom of the pool and held substantially taught by an in-pool bottom weight 530.

The exercise device 500 includes primarily an elongated, cantilever resistance arm 510. The cantilever resistance arm 510, which includes a first end 5101 and a second end 5102, preferably includes an elongated tube or truss that is sufficiently long enough that the swimmer's outreached arm will not contact the side wall of the swimming pool and high enough above the water that it will not obstruct the swimmer utilizing the exercise device and swimming thereunder in axial alignment therewith.

At the first end of the cantilever resistance arm 5101 is the mounting base 520 configured for secure engagement to a pool deck by appropriate known methods in the art. Disposed opposite the mounting base 520, at the second end of the cantilever resistance arm 5102 is a metal loop or eyelet 170 and carabiner 180 (as shown in more detail in FIG. 5). Directly below the upper metal loop or eyelet 170 at the bottom of the pool is the in-pool bottom weight 530 having a second metal loop or eyelet 170 to attach the resistance cords 190. The upper metal loop or eyelet 170 is attached pointing downward from the cantilever resistance arm 510, while the lower metal loop or eyelet 170 is attached pointing upward from the in-pool bottom weight 530.

The two padded resistance cords 190 are held vertically taught at these anchoring points. The two padded resistance cords 190 may be made from polyester cord or similar material. Surrounding the medial area of the resistance cords 190 are pads of cushioning vinyl tubing 192, or the like, that cover and soften the feel of the resistance cords 190 to the swimmer's shoulders. The two side by side resistance cords 190 are held closely together by either insertion in a center hole of the two slide balls or insertion into side by side holes in two slide blocks 191 and the opening between the two padded resistance cords 190 can be adjusted by sliding the slide balls or blocks 191 up and down. To perform the swimming exercise, the swimmer adjusts the slide balls or blocks 191 up and down to make the opening larger or smaller, inserts their head between the two padded resistance cords to the base of the neck, adjusts the slide ball or block 191 up and down to make the opening larger or smaller in order to create a comfortable and secure position of the resistance cords 190 on the shoulders, and then begins swimming toward the wall of the swimming pool, being held substantially in place by the resistance cords 190 providing resistance in a manner such that uninterrupted stroking and/or kicking is facilitated in a pool area of relatively small dimensions.

In another embodiment of the cantilever resistance arm, the shape may be arced. An arced cantilever resistance arm 510 may form a convex arc upward wherein the angle formed between the tangent of the arm and the water surface decreases gradually as one travels from the mounting base 520 of the arced cantilever resistance arm 510 to the top portion of the arm away from the base. For example, near the bottom portion of the arm the angle may be at least 60 or 80 degrees and near the top portion of the arm the angle may be no less than parallel, or minus 20 degrees.

REFERENCE CHARACTERS exercise device 500
cantilever resistance arm 510
first end 5101 and the second end 5102 of the cantilever resistance arm 510
mounting base 520
in-pool bottom weight 530
metal loops or eyelets 170
carabiners 180
resistance cords 190 (FIG. 6)
slide ball or block 191 vinyl tubing covers 192

7. Permanent Pool-Side Base-Mounted Cantilever Bar Stanchion

Figure 14:
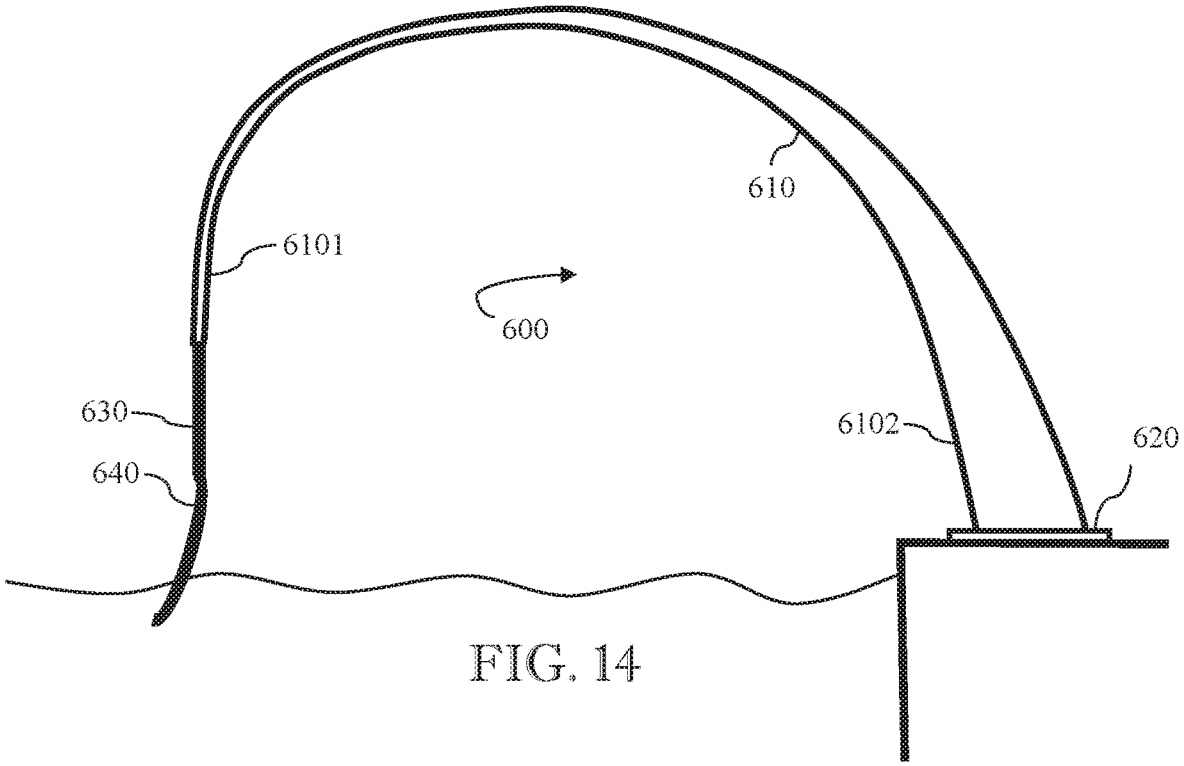
FIG. 14 is an orthographic projection side view of the permanent pool-side base-mounted cantilever bar stanchion 600, which is in accordance with another alternative embodiment of the present invention.

Shown in FIG. 14, another embodiment of the instant invention is a deck-mounted device indicated as 600 that restrains the swimmer against both shoulders at the base of the neck with a stanchion, structured to confine a user to a small section of a swimming pool, while still allowing them to enjoy the excellent cardiovascular aerobic benefits of swimming. In the case of a pool made of concrete or other strong material, the device can be mounted on or firmly attached in some suitable manner to the pool deck itself, or mounted to a portable base of sufficient weight. The device illustrated in the drawings constitutes one of the possible embodiments of the invention. The stanchion is attached to a cantilever resistance arm extending outward from the pool deck at the side of the pool over the water to remain clear of the swimmer's stoke.

The exercise device 600 includes primarily an elongated, cantilever resistance arm 610. The resistance arm 610, which includes a first end 6101 and a second end 6102, preferably includes an elongated tube or truss that is sufficiently long enough that the swimmer's outreached arm will not contact the side wall of the swimming pool and high enough above the water that it will not obstruct the swimmer utilizing the exercise device and swimming thereunder in axial alignment therewith.

Figure 14A:
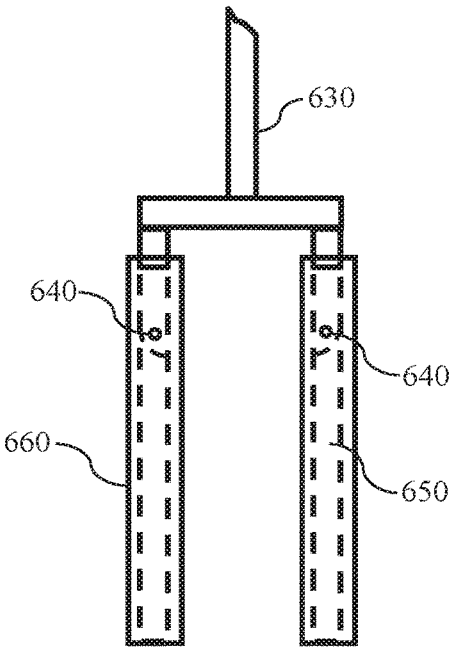
FIG. 14A is a front view of the U-shaped stanchion 630 at the distal end of the cantilever resistance arm 6101 with the downward extension bars 650 with the two hinges 640 (shown in phantom), surrounded by the soft, resilient cover pads 660.

At the first end 6101 of the cantilever resistance arm 610 is attached a U-shaped stanchion 630. FIG. 14A shows a front view of the stanchion 630 containing two downward extension bars 650 that include two hinges 640 such that they can swivel outward to widen the stanchion bars, but not inward to narrow the stanchion bars. Surrounding and carried on said downward extension bars 650 are soft, resilient cover pads 660. At the opposite end of the cantilever resistance arm 610 is a mounting base 620 configured for secure engagement to a pool deck by appropriate known methods in the art, or mounted to a portable base of sufficient weight. The stanchion means 630 is structured to provide casual resistance to the user of the swimming exercise device 600. The U-shaped stanchion 630 extends with the open end downward in a configuration adapted to receive a swimmer's head against both shoulders at the base of the neck with sufficient pressure during the swimming action for maintaining there between a mated relationship providing resistance in a manner such that uninterrupted stroking and/or kicking is facilitated in a pool area of relatively small dimensions.

REFERENCE CHARACTERS exercise device 600
first end 6101 and second end 6102 of cantilever resistance arm 610
mounting base 620
U-shaped stanchion 630 (FIG. 14A)
two hinges 640
downward extension bars 650
soft, resilient cover pads 660

The embodiments disclosed herein enable the restraint of a user engaging in swimming and other waterborne exercises, such that the user may be held substantially stationary while exercising, and such that substantial translation of the user—e.g., a significant change in user position relative to a pool—is prevented. As used herein, a "restraint" may refer to one or more components in one or more of the embodiments described above that facilitate such user restraint and substantially stationary positioning during exercise via releasable engagement of the user with the restraint (e.g., via the shoulders and neck). For example, the restraint may refer to the stanchion 40 of FIG. 1, the resistance cords 190 of FIG. 4C, the resistance members 2201 and 2202 of FIGS. 7A-7C, and/or to other components. As used herein, an "abutment structure" may refer to one or more components in one or more of the embodiments described above that contact a pool surface (e.g., bottom pool surface, side pool surface, exterior pool surface that is external to water in a pool) and help restrain a user and exercise device in a substantially stationary manner during use by the user. An abutment structure may facilitate such restraint by receiving forces imparted by the user to a restraint (and transmitted from the restraint to the abutment structure via one or more intermediate components such as a resistance arm), and transmitting the forces to the pool surface, with which opposing forces may be generated to enable such restraint and oppose translation of the user during exercise that might otherwise result without restraint of the user. For example, the abutment structure may refer to one or more of the T-shaped member 310, cross braces 32 and 33, and floatation members 36 and 37 of FIG. 1; one or more of the resistance frame 110 and supporting feet 150 of FIG. 3; one or more of the tubular frame 210 and supporting feet 215 of FIGS. 7A-7C; one or more of the buffer member 330, resistance base frame 340, Y-shaped base 350, and soft bumpers 360 of FIG. 8; the mounting base 420 of FIG. 11; the mounting base 520 of FIG. 13; the mounting base 620 of FIG. 14; and/or to other components.

It is to be understood that any appropriate assembly described above may be weighted down using a substantial (e.g. dense and/or heavy) base, or be bolted to a pool deck. Further, it is to be understood that the term permanent may refer to affixing, attaching, and/or coupling a base to a pool deck in a fixed or removably attachable way.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A swimming exercise device, comprising:

a restraint including a pair of resistance cords providing an opening and a contact portion on the resistance cords, the restraint configured to receive a head of a user through the opening and to restrain the user, via contact between shoulders of the user and the contact portion on the resistance cords, such that the user is held substantially stationary during forward motion of the user against the restraint, the restraint configured such that the user's arms do not contact the pair of resistance cords of the restraint when performing a natural swimming motion; and an abutment comprising, a mounting base attachable to a pool deck surface, the mounting base including a vertical post at about an end of the mounting base, a support arm that includes a distal end and a proximal end, the distal end of the support arm includes a skid resistant member and the proximal end of the support arm includes a pivot joint, the pivot joint pivotally attached to the post of the mounting base allowing the support arm to pivot upwardly and downwardly therefrom, and a semi-circular frame attachable to the distal end of the support arm having two opposite ends, one end of the opposite ends being superior to the other end, and the semi-circular frame having a central joint intermediately positioned between the two opposite ends, wherein the restraint extends between the first superior end and the second inferior end of the semi-circular frame, wherein the skid resistant member makes contact with an interior pool edge only when the support arm is in a downward position, and wherein the structure is configured to contact the pool deck surface and transmit forces associated with the forward motion of the user against the restraint to the pool surface.

2. The swimming exercise device of claim 1, wherein the mounting base attachable to the pool deck includes support members.

3. The swimming exercise device of claim 2, wherein the support members are soft bumpers that cushion a weight of the abutment on the pool deck.

4. The swimming exercise device of claim 1, wherein the pivot joint pivotally attached to the post of the mounting base allowing the support arm to pivot upwardly and downwardly therefrom is a clevis bracket.

5. The swimming exercise device of claim 1, wherein the mounting base comprises a Y-shaped tripodal base shape that includes skid-resistant support feet.

6. The swimming exercise device of claim 1, wherein the mounting base is constructed of non-rusting metal.

7. The swimming exercise device of claim 1, wherein the mounting base is constructed of an aluminum alloy, stainless stell, or carbon fiber.

8. The swimming exercise device of claim 1, wherein the mounting base is unremovably attached to the pool deck.

* * * * *